US011054766B2

(12) United States Patent
Mitsuoka

(10) Patent No.: US 11,054,766 B2
(45) Date of Patent: Jul. 6, 2021

(54) FIXING DEVICE AND IMAGE FORMING APPARATUS

(71) Applicant: SHARP KABUSHIKI KAISHA, Sakai (JP)

(72) Inventor: Tetsunori Mitsuoka, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/810,191

(22) Filed: Mar. 5, 2020

(65) Prior Publication Data

US 2020/0301331 A1 Sep. 24, 2020

(30) Foreign Application Priority Data

Mar. 20, 2019 (JP) ..... JP2019-052446

(51) Int. Cl.
*G03G 15/20* (2006.01)

(52) U.S. Cl.
CPC ..... *G03G 15/2017* (2013.01); *G03G 15/2057* (2013.01)

(58) Field of Classification Search
CPC ..... G03G 15/23017; G03G 2215/20; G03G 2215/2003; G03G 15/2017
See application file for complete search history.

(56) References Cited

U.S. PATENT DOCUMENTS 5,903,810 A * 5/1999 Adachi ..... G03G 15/2064 219/216
7,546,058 B2 * 6/2009 Katoh ..... G03G 21/203 399/92
10,078,297 B2 * 9/2018 Imaizumi ..... G03G 15/2017

FOREIGN PATENT DOCUMENTS

JP H06-075491 A 3/1994
JP 2003-345155 A 12/2003
JP 2005031562 A * 2/2005

* cited by examiner

*Primary Examiner* — Erika J Villaluna
(74) *Attorney, Agent, or Firm* — ScienBiziP, P.C.

(57) ABSTRACT

A fixing device in an image forming apparatus includes a partition member providing a partition between a pressure roller and a housing. The partition member is disposed against the pressure roller along a rotation-axis direction X of the pressure roller. The partition member has a first side face against the pressure roller. The first side face is provided with a thermal insulation member thereon. The thermal insulation member is separated from the pressure roller by a prescribed distance.

7 Claims, 8 Drawing Sheets

FIXING DEVICE AND IMAGE FORMING APPARATUS

CROSS-REFERENCE TO RELATED APPLICATIONS

The present application claims the benefit of priority to Japanese Patent Application, Tokugan, No. 2019-052446 filed on Mar. 20, 2019, the entire contents of which are incorporated herein by reference.

FIELD OF THE INVENTION

The present invention relates to fixing devices that fix a toner image on printing paper and image forming apparatuses including such a fixing device.

BACKGROUND OF THE INVENTION

A fixing device used in an electrophotographic image forming apparatus such as a copying machine or a printer includes a pair of a fixing roller and a pressure roller. These rollers are pressed against each other, and one of them is heated. Unfixed toner images are fixed onto printing paper by being pressed and heated by the pair of rollers. Another fixing technique, termed a "belt fixing technique," includes a fixing roller, a heating roller, and a fixing belt suspended between the rollers, so that the fixing and pressure rollers can be pressed against each other with the fixing belt intervening therebetween.

Fixing temperature needs to be controlled appropriately in these types of image forming apparatuses to prevent, for example, improper fixing. It has been proposed, for example, to restrain heat dissipation and improve heating properties to reduce time taken to reach a temperature at which fixing is possible.

Patent Literature 1 Japanese Unexamined Patent Application Publication, Tokukaihei, No. 6-75491), as an example, discloses a structure including a thermal insulation member disposed so as to cover substantially a half of the outer circumferential surface of a hot roller and so as to slide in contact with the outer circumferential surface, for the purpose of inhibiting the heat of the hot roller from leaking outside. Patent Literature 2 (Japanese Unexamined Patent Application Publication, Tokukai, No. 2003-345155), as another example, discloses a structure including as a shielding cover an air-containing layer of felt or a like material between two metal layers, for the purpose of preventing the heat generated in the fixing device from leaking outside.

SUMMARY OF THE INVENTION

Problems to be Solved by the Invention

Recent increasing demand for enhanced energy saving capability has prompted the need to prevent heat flow out of the fixing device and heat loss in the fixing device, which can further reduce power consumption in heating up the fixing device. In view of these issues, the structures of Patent Literature 1 and 2 still have room for improvement. In the structure of Patent Literature 1, the thermal insulation member, sliding in contact with the hot roller, can take up heat from the hot roller and increase the time taken to raise the temperature of the hot roller. Meanwhile, in the structure of Patent Literature 2, the heat loss reducing effect of the shielding cover decreases with time.

The present invention therefore provides a fixing device and an image forming apparatus that are new.

Solution to the Problems

The present invention is directed to a fixing device including: a rotation member; a housing enclosing the rotation member; and a partition member providing a partition between the rotation member and an inner face of the housing, wherein the partition member is disposed against the rotation member along a rotation-axis direction of the rotation member, the partition member has a first side face against the rotation member, the first side face being provided with a thermal insulation member thereon, and the thermal insulation member is separated from the rotation member by a prescribed distance.

In the fixing device structured as above, the partition member preferably has a second side face opposite the first side face, the second side face being separated from the inner face of the housing by a space.

In the fixing device, the distance separating the thermal insulation member from the rotation member is preferably smaller than a thickness of the thermal insulation member in a direction perpendicular to the rotation-axis direction of the rotation member.

In the fixing device, the thermal insulation member is preferably disposed so as to provide a large area below a location where the distance separating the thermal insulation member from the rotation member is smallest.

In the fixing device, the thermal insulation member preferably includes thermal insulation material layers of different thermal conductivities stacked in a thickness direction.

In the fixing device, the thermal conductivity of one of the thermal insulation material layers that is stacked on a partition member side is preferably smaller than the thermal conductivity of one of the thermal insulation material layers that is stacked on a rotation member side.

In the fixing device, the partition member is preferably bent along an exterior of the rotation member.

The present invention is directed to an image forming apparatus including the fixing device.

DESCRIPTION OF EMBODIMENTS

The following will describe fixing devices and image forming apparatuses including a fixing device in accordance with embodiments of the present invention, with reference to drawings.

Embodiment 1

Overall Structure of Image Forming Apparatus

Figure 1:
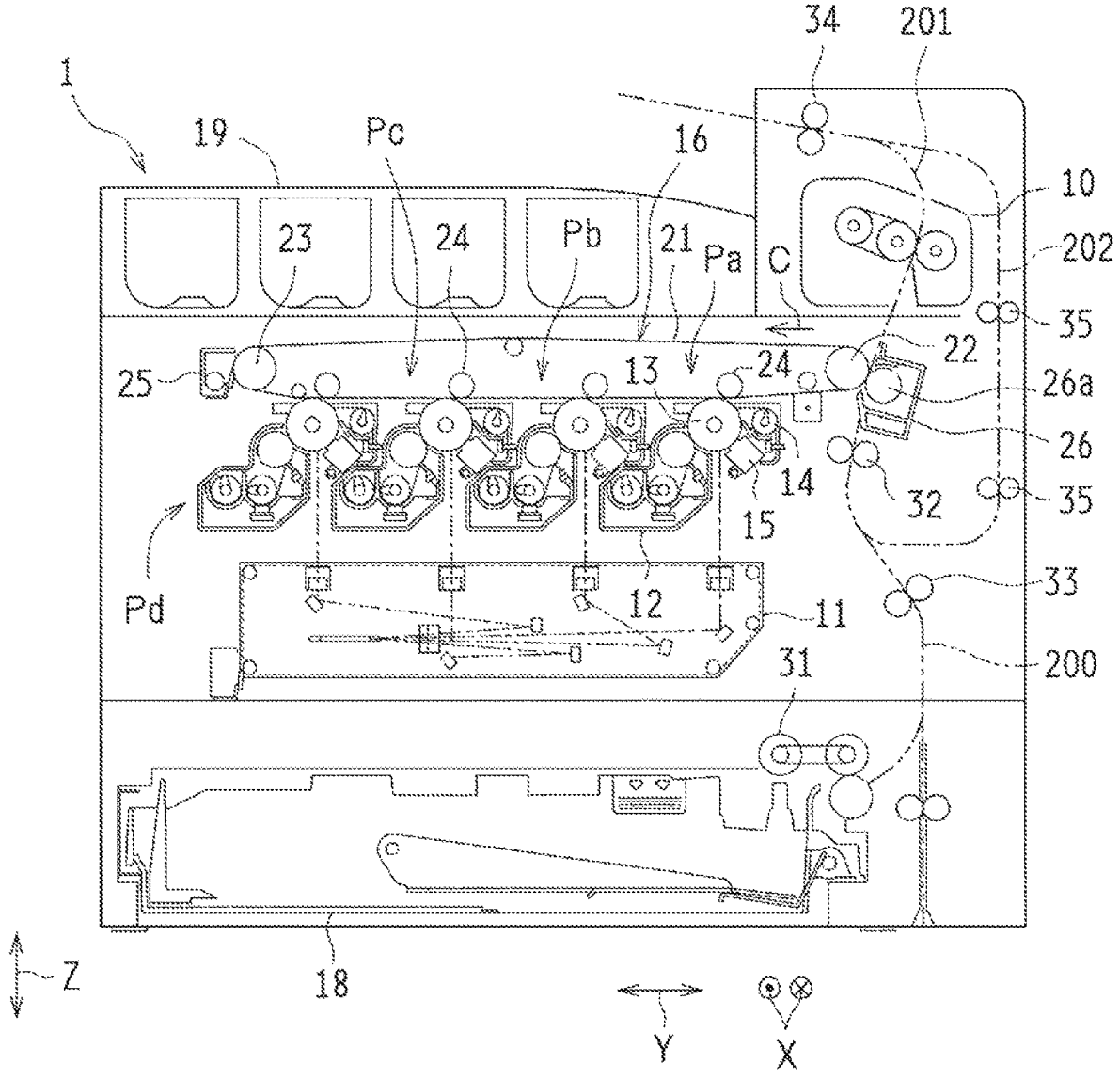
FIG. 1 is a schematic side view of an image forming apparatus in accordance with Embodiment 1 of the present invention.

FIG. 1 is a schematic side view of an image forming apparatus 1 including a fixing device 10 in accordance with Embodiment 1 of the present invention. FIG. 1 shows "X" denoting the direction of the rotation axis of a rotation member detailed later (depth direction or "rotation-axis direction" X), "Y" denoting the left and right direction which is at right angles to the depth direction, and "Z" denoting the up and down direction.

The image forming apparatus 1 in accordance with Embodiment 1 includes an exposure unit 11, developing units 12, photosensitive drums 13, cleaner units 14, charging units 15, an intermediate transfer belt unit 16, the fixing device 10, a paper feed tray 18, a paper ejection tray 19, and a printing paper transport path 200. The image forming apparatus 1 forms multicolor and monochromatic images on prescribed printing paper in accordance with image data transmitted from an external device.

The image forming apparatus 1 is capable of handling image data representing color images of black (K), cyan (C), magenta (M), and yellow (Y). There are provided four sets of the developing unit 12, the photosensitive drum 13, the charging unit 15, and the cleaner unit 14 in the image forming apparatus 1, to form four latent images of different colors. Each set is associated with a different one of the black, cyan, magenta, and yellow colors, constituting a corresponding image station Pa, Pb, Pc, or Pd.

The photosensitive drums 13 are located substantially at the center of the image forming apparatus 1. The charging units 15 charge the surfaces of the photosensitive drums 13 uniformly to a prescribed electrical potential. The exposure unit 11 illuminates the surfaces of the photosensitive drums 13 with light to form electrostatic latent images thereon. The developing units 12 develop the electrostatic latent images on the surfaces of the photosensitive drums 13 to form toner images on the surfaces of the photosensitive drums 13.

These processes for a toner image of each color on the surface of the corresponding photosensitive drum 13. The cleaner units 14 remove and collect residual toner from the surfaces of the photosensitive drums 13 after the developing and image transfer processes.

The intermediate transfer belt unit 16 is disposed above the photosensitive drums 13 and includes an intermediate transfer belt 21, an intermediate transfer belt drive roller 22, an intermediate transfer belt idler roller 23, intermediate transfer rollers 24, and an intermediate transfer belt cleaning unit 25. There are provided four intermediate transfer rollers 24 each associated with a different one of the YMCK image stations Pa, Pb, Pc, and Pd.

The intermediate transfer belt 21 is stretched and suspended by the intermediate transfer belt drive roller 22, the intermediate transfer belt idler roller 23, and the intermediate transfer rollers 24, so that the surface of the intermediate transfer belt 21 can move in a prescribed direction (direction indicated by arrow C in the drawing).

The intermediate transfer belt 21 rotates in the direction indicated by arrow C and transports thereon residual toner that is removed and collected by the intermediate transfer belt cleaning unit 25. The toner images of different colors formed on the surfaces of the photosensitive drums 13 are sequentially transferred and superimposed one over the other, to form a color toner image on the surface of the intermediate transfer belt 21.

The image forming apparatus 1 further includes a secondary transfer unit 26 including a transfer roller **26*a*. The transfer roller 26*a* forms a nip region between itself and the intermediate transfer belt 21 to sandwich in the nip region the printing paper transported in the printing paper transport path 200. The toner image on the surface of the intermediate transfer belt 21** is transferred to the printing paper when the printing paper passes through the nip region.

The paper feed tray 18, disposed below the exposure unit 11, contains printing paper for use in the image formation. The paper ejection tray 19, disposed above the image forming apparatus 1, receives printing paper having an image formed thereon.

The printing paper transport path 200 includes a main path 201 and a turn-over path 202 that branches off from the main path 201 near the halfway point thereof and then merges downstream with the main path 201. Along the main path 201 are there provided pickup rollers 31, pre-registration rollers 33, registration rollers 32, the secondary transfer unit 26, the fixing device 10, and paper ejection rollers 34. The turn-over path 202 branches off between the fixing device 10 and the paper ejection rollers 34, runs between transport rollers 35, and merges between the pre-registration rollers 33 and the registration rollers 32.

The pickup rollers 31 are disposed near an end of the paper feed tray 18 to supply printing paper a sheet at a time from the paper feed tray 18 to the printing paper transport path 200. The registration rollers 32 temporarily hold the printing paper coming from the paper feed tray 18 to feed the printing paper to the transfer roller **26*a* at such a timing that the leading edge of the toner image on the photosensitive drum 13 aligns with the leading edge of the printing paper. The pre-registration rollers 33** are compact rollers facilitating and assisting the transport of printing paper.

The fixing device 10 is of a belt fixing type and includes a plurality of rotation members. There is suspended a fixing belt 43 (rotation member) around a fixing roller 41 and a heating roller 42 (rotation members) (see FIG. 2 detailed later).

In the fixing device 10, a pressure roller 44 is pressed against the fixing roller 41 with the fixing belt 43 intervening therebetween. The fixing device 10 receives printing paper having a toner image formed (but yet to be fixed) thereon and transports the printing paper by sandwiching the printing paper between the fixing belt 43 and the pressure roller 44. After the toner image is fixed, the printing paper is ejected onto the paper ejection tray 19 by the paper ejection rollers 34.

To form an image on the backside of the printing paper as well as on the front side of the printing paper, the printing paper is flipped over by being transported backward from the paper ejection rollers 34 to the turn-over path 202. The printing paper is then sent again to the registration rollers 32 to form an image on the backside in the same manner as an image was formed on the front side, before being ejected onto the paper ejection tray 19.

At least one of the four image stations Pa, Pb, Pc, and Pd may form a monochromatic image to transfer the monochromatic image to the intermediate transfer belt 21 in the intermediate transfer belt unit 16. The monochromatic image is transferred from the intermediate transfer belt 21 to the printing paper and then fixed in the same manner as a color image is transferred and fixed.

Basic Structure of Fixing Device

Next will be described a structure of the fixing device 10 in detail in accordance with Embodiment 1 of the present invention.

Figure 2:
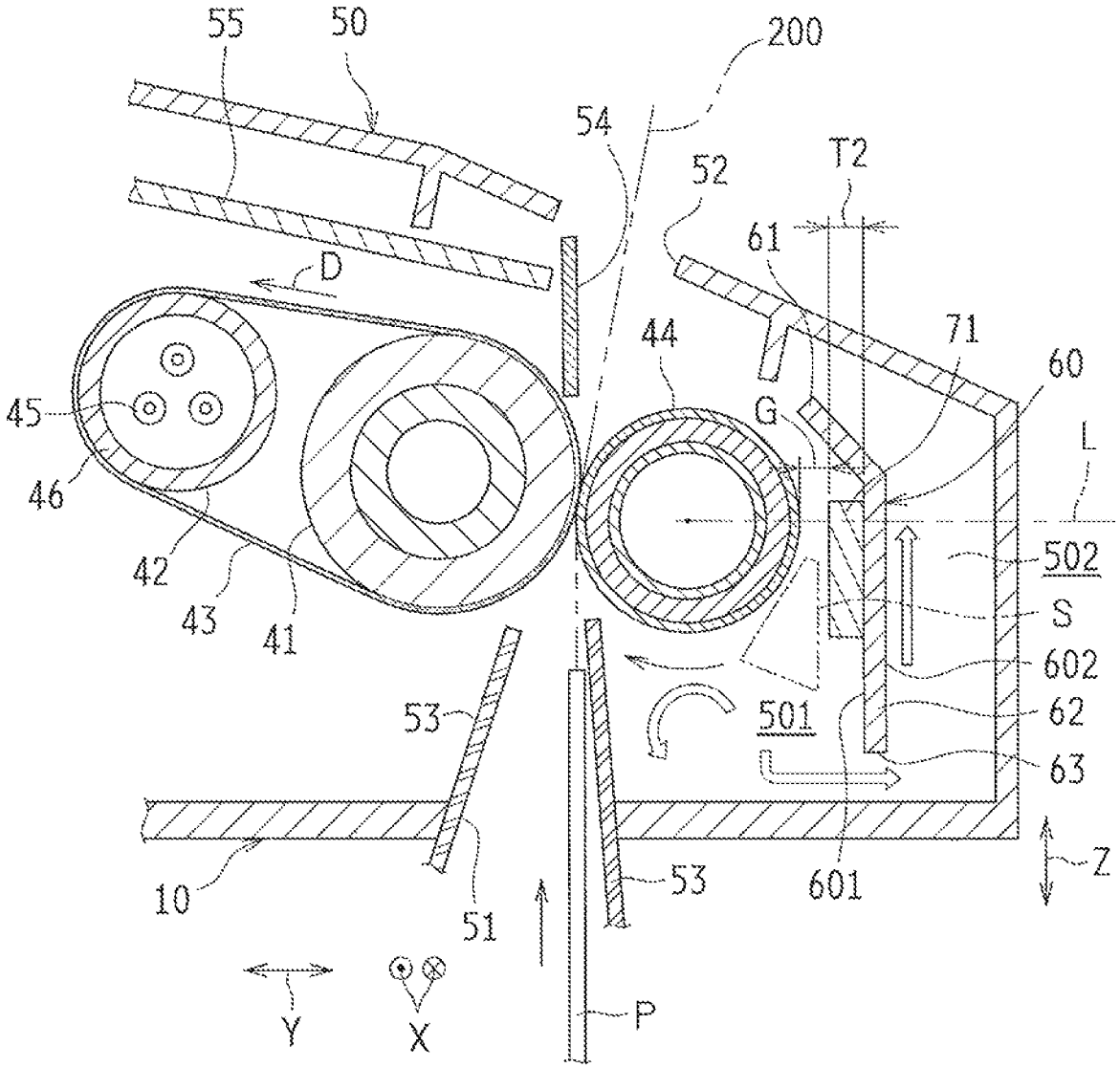
FIG. 2 is a schematic cross-sectional view of a fixing device in accordance with Embodiment 1 of the present invention.

FIG. 2 is a schematic cross-sectional view of the fixing device 10 in accordance with Embodiment 1. The fixing device 10 includes the fixing roller 41, the heating roller 42, the fixing belt 43, and the pressure roller 44 (all rotation members) enclosed in a housing 50. In the fixing device 10, the printing paper P is sandwiched by the fixing roller 41 and the pressure roller 44, which is pressed against the fixing roller 41, with the fixing belt 43 suspended by the fixing roller 41 and the heating roller 42 and intervening between the fixing roller 41 and the pressure roller 44. The toner image on the printing paper P is fixed when the printing paper P is passed between the fixing roller 41 and the pressure roller 44.

The fixing roller 41 is a cylindrical roller connected to a drive unit (not shown) and includes a core bar of stainless steel and an elastic layer of a silicone sponge rubber surrounding the core bar.

The heating roller 42 includes a plurality of heating members 45 disposed therein and is provided with a thermal conduction layer 46 covering the heating members 45. The heating members 45 are, for example, halogen lamps or like lamp heaters. The heating members 45 generate heat that travels through the thermal conduction layer 46 and heats up the entire heating roller 42. The heating members 45, when being lamp heaters, can heat up across the fixing belt 43 and reduce the price of the fixing device 10 because lamp heaters are inexpensive.

The pressure roller 44 includes, for example, a core bar of an iron alloy (STKM), an elastic layer of a silicone solid rubber surrounding the core bar, and a tubular releasing layer of PFA surrounding the elastic layer. The pressure roller 44 is located opposite the fixing roller 41 across the fixing belt 43.

The fixing belt 43 is an endless belt and includes, for example, a base member of polyimide, an elastic layer of a silicone rubber, and a tubular releasing layer of PFA being stacked in this sequence from the interior to the exterior. The fixing belt 43 rotates in the direction indicated by arrow D.

The rotation members, including the fixing roller 41, the heating roller 42, the fixing belt 43, and the pressure roller 44, are contained inside the housing 50. The fixing roller 41, the heating roller 42, and the pressure roller 44 are disposed along the rotation-axis direction X, and the fixing belt 43 is so disposed that its belt width direction coincides with the rotation-axis direction X.

The housing 50 is composed of, for example, a flame-retardant synthetic resin material and is structured to surround and contain all the fixing roller 41, the heating roller 42, the fixing belt 43, and the pressure roller 44. The housing 50 has a paper feeding slot 51 and a paper ejection slot 52 on the printing paper transport path 200 along which printing paper P is moved. The paper feeding slot 51 has guide members 53. The housing 50, hence structured, has an internal empty space substantially surrounded by the housing 50, the pressure roller 44, and one of the guide members 53 on the same side of the printing paper transport path 200 as the pressure roller 44.

There is provided a peeling member 54 near the fixing roller 41 extending in the rotation-axis direction X of the fixing roller 41. The peeling member 54 peels printing paper P off the fixing roller 41 and guides the printing paper P toward the paper ejection slot 52. The peeling member 54 may be disposed in a swingable manner to avoid being in contact with the same portion of the fixing roller 41. The fixing belt 43 is supported by a belt support member 55 provided in the housing 50.

Partition Member

Referring to FIG. 2, inside the housing 50 is there provided a partition member 60 providing a partition separating the pressure roller 44, which is one of rotation members, from the inner faces of the housing 50. The partition member 60 is, for example, a plate of zinc-plated steel or like metal. The partition member 60 is disposed facing the pressure roller 44 and extending in the rotation-axis direction X of the pressure roller 44.

The partition member 60, disposed facing the pressure roller 44 in the present embodiment, is provided in accordance with the positional arrangement of the pressure roller 44. The partition member 60, in the example shown in FIG. 2, includes an upper plate 61 and a lower plate 62 and is disposed near the pressure roller 44 and bent along the exterior of the pressure roller 44.

The lower plate 62 extends in the up and down direction Z inside the housing 50. The upper plate 61 is connected at an angle to the upper end of the lower plate 62 and extended obliquely upward along the exterior of the pressure roller 44. There is provided an opening 63 below the lower plate 62 between the lower plate 62 and an inner face of the housing 50. FIG. 2 shows that the partition member 60 thus structured has a length in the rotation-axis direction X that is greater than or equal to that of the pressure roller 44 in the rotation-axis direction X.

The provision of the partition member 60 in the housing 50 partitions the empty space between the pressure roller 44 and the inner faces of the housing 50. One of the faces of the partition member 60 that is on the same side as the pressure roller 44 will be referred to as a first side face 601, whereas the other face of the partition member 60 that is opposite the first side face 601 and on the same side as an inner face of the housing 50 will be referred to as a second side face 602. The partition member 60 is disposed in such a manner that the distance from the first side face 601 of the partition member 60 to the exterior of the pressure roller 44 in the left and right direction Y is smaller than the distance from the second side face 602 of the partition member 60 to that inner face of the housing 50 in the left and right direction Y.

This arrangement provides a first empty space 501 between the pressure roller 44 and the first side face 601 of the partition member 60 and provides a second empty space 502 between the housing 50 and the second side face 602 of the partition member 60, in the housing 50 of the fixing device 10. The partition member 60 functions to generate a convection current of air around the pressure roller 44 in the first empty space 501 and to restrain convection between the first empty space 501 and the second empty space 502.

The partition member 60 includes a thermal insulation member 71 on the first side face 601 facing the pressure roller 44. In the structure shown in FIG. 2, the thermal insulation member 71 is on the first side face 601 of the lower plate 62 of the partition member 60. FIG. 2 shows that the thermal insulation member 71, similarly to the partition member 60, has a length in the rotation-axis direction X that is greater than or equal to that of the pressure roller 44 in the rotation-axis direction X. This specification renders the first empty space 501 formed by the partition member 60 much smaller than the second empty space 502.

The thermal insulation member 71 may be made of thermally resistant felt or foam sponge. The thermally resistant felt may be, as a preferred example, thermally resistant, flame retardant, and thermally insulating felt prepared by entangling flameproof carbonized fibers. The thermal insulation member 71 may alternatively be a thermal insulation sheet or porous mat with a thermal conductivity of from 0.01 to 0.035 W/mK prepared by impregnating fiber with silica aerogel and fabricating the resultant porosity-sealed fiber in a sheet-like shape.

The thermal insulation member 71 preferably has a thermal conductivity of from 0.015 to 0.06 W/mK when the thermal insulation member 71 is made of thermally resistant felt and from 0.03 to 0.15 W/mK when the thermal insulation member 71 is made of thermally resistant foam sponge or expanded foam. The expanded foam may be, for example, a polyimide-based expanded foam with a void ratio of from 50 to 95% and a thermal conductivity of from 0.035 to 0.044 W/mK.

The thermal insulation member 71 has such a thickness T2 (protrusion thickness of the partition member 60 from the first side face 601) that the thermal insulation member 71 can be separated from the pressure roller 44 by a prescribed distance. Both the thermal insulation member 71 and the partition member 60 are structured so as to reduce the thermal transmittance of the thermal insulation member 71, the partition member 60, and their environment.

Referring to FIG. 2, assume an imaginary plane L that contains the rotation axis of the pressure roller 44 and expands in the left and right direction Y. It is also specified that the distance separating the thermal insulation member 71 from the pressure roller 44 is in the direction perpendicular to the rotation-axis direction X (the left and right direction Y in this example). Under these conditions, the distance separating the thermal insulation member 71 from the pressure roller 44 is smallest in the imaginary plane L. There is provided a gap (distance) G between the thermal insulation member 71 and the pressure roller 44 in these locations where the distance is smallest. The gap G is provided so as to be smaller than the thickness T2 of the thermal insulation member 71.

The thermal insulation member 71 is disposed below the imaginary plane L where the gap G is provided, so as to provide a larger surface area. The gap G between the thermal insulation member 71 and the pressure roller 44 is hence smaller than the thickness T2 of the thermal insulation member 71 for an effect of restraining large heat convection from occurring around the pressure roller 44. In addition, the gap G provides a passage for a heat convection current of air and thus allows heat convection below the imaginary plane L, but restricts rising radiation heat, thereby mitigating diffusion of heat, because the gap G is narrowed down by the thermal insulation member 71 which is thermally insulating and which also provides a large passage resistance for the purpose of restraining a flow of fluid air.

There is provided a heat retention region S between the thermal insulation member 71 and the pressure roller 44 inside the first empty space 501 which is below the gap G in the housing 50. The retention region S can mitigate temperature drops in the air around the pressure roller 44, thereby reducing heat loss.

Some of the convection current of air in the first empty space 501 below the gap G moves into the second empty space 502 through the opening 63 below the partition member 60 and then moves upward in the second empty space 502. The opening 63 is, however, provided below the partition member 60 at a distance from the pressure roller 44. The opening 63 therefore does not affect heat loss by the pressure roller 44.

The image forming apparatus 1, including the fixing device 10 described above, is not necessarily a color image forming apparatus that forms multicolor and monochromatic images on printing paper P, but may be an image forming apparatus that forms monochromatic images. In a monochromatic image forming apparatus, the pressure roller 44 preferably includes silicone sponge as the elastic layer surrounding the core bar. The provision of the partition member 60 and the thermal insulation member 71 facing the pressure roller 44, as in the present embodiment, can advantageously reduce power consumption.

The thermal insulation member 71, provided on the partition member 60 to mitigate heat convection, can be altered in various manners as described in the following.

Example 1

Figure 3:
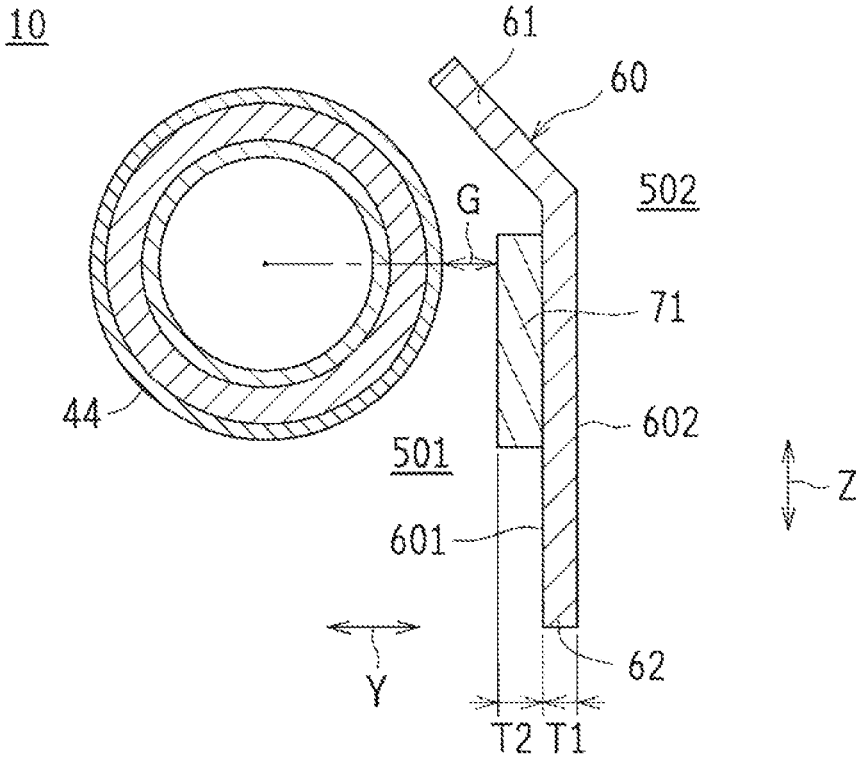
FIG. 3 is a schematic cross-sectional view of a partition member and a thermal insulation member of Example 1 in the fixing device.
Figure 4:
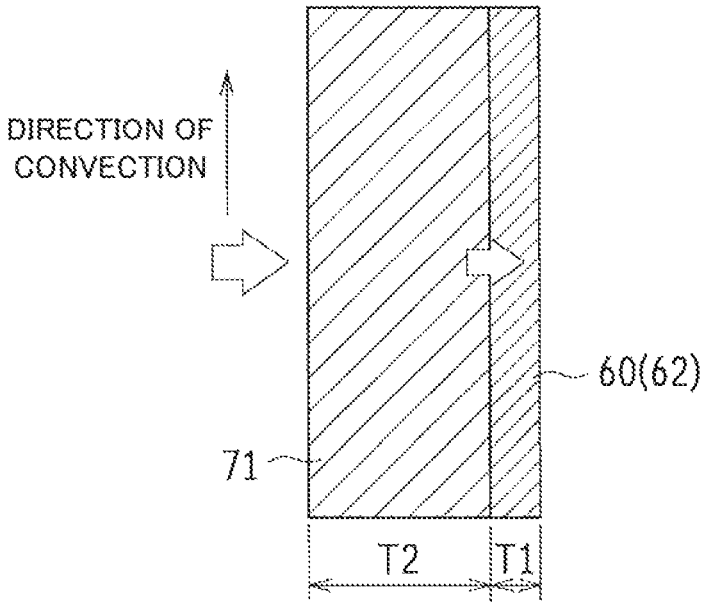
FIG. 4 is an enlarged partial cross-sectional view of the partition member and the thermal insulation member in FIG. 3.

FIG. 3 is a schematic cross-sectional view of the partition member 60 and the thermal insulation member 71 in the fixing device 10 in accordance with Example 1. FIG. 4 is an enlarged partial cross-sectional view of the partition member 60 and the thermal insulation member 71 in FIG. 3.

The partition member 60 and the thermal insulation member 71 in the fixing device 10 in accordance with Example 1 have the same structure as those shown in FIG. 2. The thermal insulation member 71 is provided on the first side face 601 of the lower plate 62 of the partition member 60 and provides a larger area below the gap G between the thermal insulation member 71 and the pressure roller 44.

The partition member 60 is made of a zinc-plated steel plate and has a thickness T1 of 0.3 mm. This zinc-plated steel plate has a thermal conductivity of 53 W/mK.

Meanwhile, the thermal insulation member 71 is made of thermally resistant felt with a thermal conductivity of 0.04 W/mK. The gap G between the thermal insulation member 71 and the pressure roller 44 is 1.5 mm wide, in which case the thermal insulation member 71 has a thickness T2 of 2 mm.

The thermal insulation member 71 receives heat from the pressure roller 44 side through a convection current of a thermal fluid (surrounding air. Since the thermal insulation member 71 has a low thermal conductivity and a low thermal transmittance as described earlier, the thermal insulation member 71 restrains heat transfer to the partition member 60. This mechanism reduces the heat loss caused by the provision of the partition member 60 to a very low level. The convection current of air around the pressure roller 44 flows along the up and down direction Z. The gap G is however so small that the gap G can efficiently reduce the upward heat transfer through the gap G.

Specifying the thermal transmittance of the thermal insulation member 71 to be lower than the thermal transmittance of the partition member 60 can effectively and simultaneously reduce the loss caused by restrained heat convection and the loss caused by the heat transfer to the partition member 60, thereby contributing to reduction of power consumption.

Example 2

Figure 5:
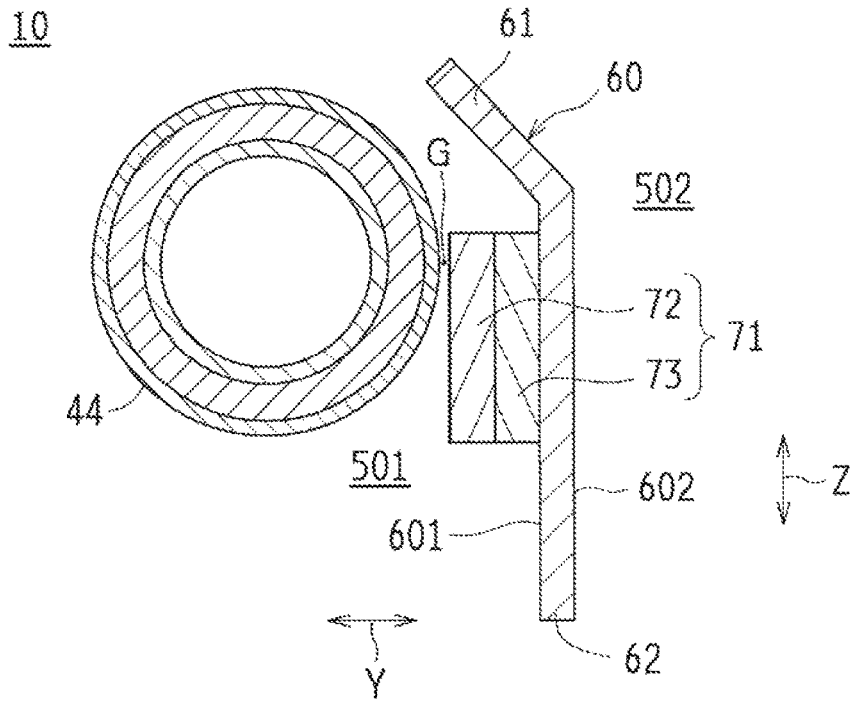
FIG. 5 is a schematic cross-sectional view of a partition member and a thermal insulation member of Example 2 in the fixing device.
Figure 6:
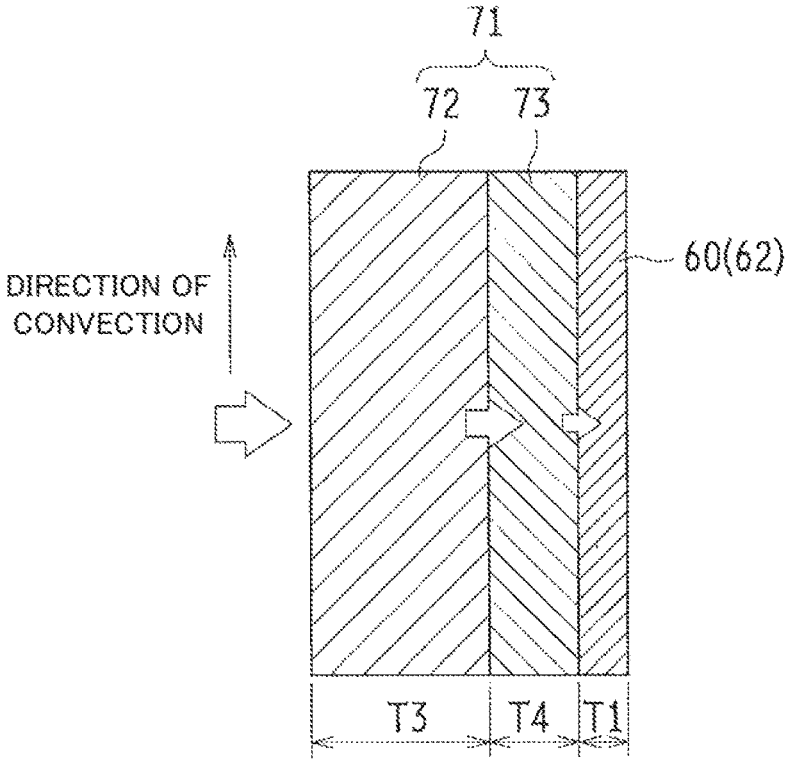
FIG. 6 is an enlarged partial cross-sectional view of the partition member and the thermal insulation member in FIG. 5.

FIG. 5 is a schematic cross-sectional view of the partition member 60 and the thermal insulation member 71 in the fixing device 10 in accordance with Example 2. FIG. 6 is an enlarged partial cross-sectional view of the partition member 60 and the thermal insulation member 71 in FIG. 5.

Example 2 differs from Example 1 in that the thermal insulation member 71 of Example 2 includes a plurality of thermal insulation material layers being stacked in the thickness direction (left and right direction Y), each thermal insulation material layer having a different thermal conductivity. As shown in FIGS. 5 and 6, the thermal insulation member 71 includes two thermal insulation material layers 72 and 73.

Both the thermal insulation material layers 72 and 73 are made of thermally resistant felt similarly to the thermal insulation member 71 described in Example 1. Referring to FIG. 6, the thermal insulation material layer 72 has a thickness T3 of 2 mm and a thermal conductivity of 0.052 W/mK. Meanwhile, the thermal insulation material layer 73 has a thickness T4 of 1 mm and a thermal conductivity of 0.04 W/mK.

Taking the thicknesses of the thermal insulation material layers 72 and 73 into account, the thermal insulation material layer 72 may have a low thermal conductivity, and the thermal insulation material layer 73 may have a high thermal conductivity. This variation is possible when the thermal transmittance is replaced by the resistance to heat transfer as an index. The variation allows for selection of a suitable thermal conductivity and thickness with a view to strike a good balance between cost, heat loss, and other factors.

The thermal insulation member 71, including the two stacked layers, has a total thickness of 3 mm and provides a gap G as small as 0.5 mm between the thermal insulation member 71 and the pressure roller 44.

With the stacked thermal insulation material layers 72 and 73 having different thicknesses T3 and T4, the thermal conductivity is lower in the thermal insulation material layer 73 disposed closer to the partition member 60 than in the thermal insulation material layer 72 disposed closer to the pressure roller 44. The thermal transmittance is lower in the thermal insulation material layer 73 disposed closer to the partition member 60 than in the thermal insulation material layer 72 disposed closer to the pressure roller 44.

In other words, the thermal insulation material layers 72 and 73, which constitute a multilayer structure, are specified to have such different thermal conductivities as to first disrupt heat transfer from the pressure roller 44 side. This specification allows the thermal insulation material layers to have a relatively small thinness and a low thermal capacity and also allows the thermal insulation material layers 72 and 73 and the partition member 60 as a whole to have a low total thermal transmittance.

Heat is hence transmitted from the pressure roller 44 side to the thermal insulation material layer 72 on the thermal insulation member 71 through a convection current of a thermal fluid (surrounding air). The low thermal conductivity and thermal transmittance of the thermal insulation material layer 72 reduce heat transfer to the thermal insulation material layer 73 to a low level. The even lower thermal conductivity and thermal transmittance of the thermal insulation material layer 73 reduce heat transfer from the thermal insulation material layer 73 to the partition member 60 to a very low level. This mechanism reduces heat loss to a low level and efficiently reduces the upward heat transfer through the gap G.

The thermal insulation member 71 does not necessarily include a stack of two layers and may include a stack of three or more layers. The thermal insulation material layers 72, 73 . . . are not necessarily made of the same material and may constitute a stack of different thermally resistant members. For instance, the thermal insulation material layer 72 may be made of thermally resistant foam sponge, and the thermal insulation material layer 73 may be made of a thermally resistant felt that has a lower thermal conductivity than the thermally resistant foam sponge. Rendering the thermal transmittances of the thermal insulation material layers 72 and 73 lower than that of the partition member 60 enables restraining heat transfer to the partition member 60.

Example 3

Figure 7:
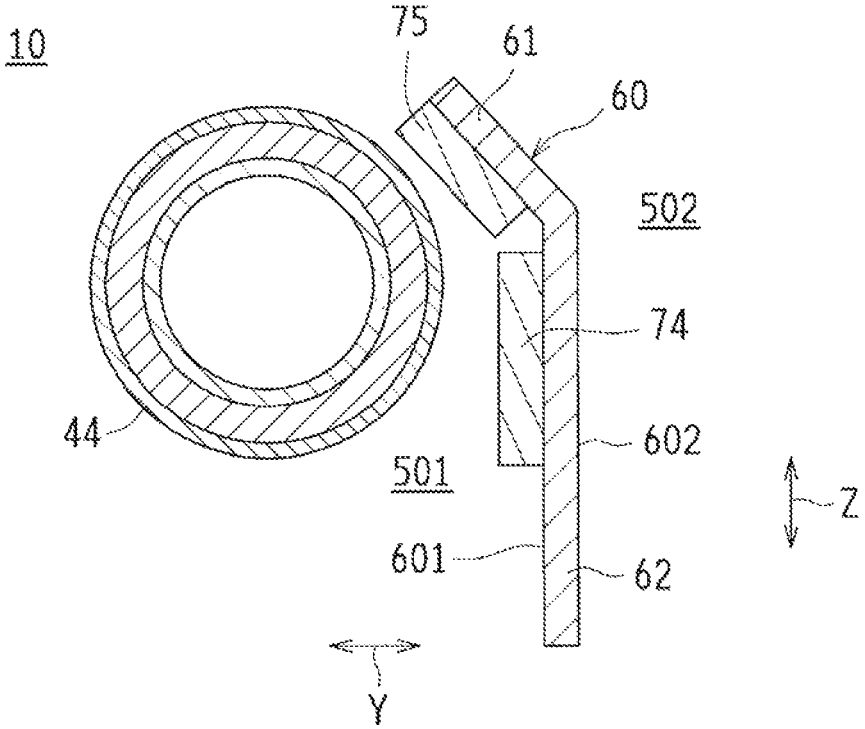
FIG. 7 is a schematic cross-sectional view of a partition member and thermal insulation members of Example 3 in the fixing device.

FIG. 7 is a schematic cross-sectional view of a partition member 60 and thermal insulation members 74 and 75 in the fixing device 10 in accordance with Example 3.

Example 3 differs from Example 1 in that the upper plate 61 of the partition ember 60 of Example 3 includes the second thermal insulation member 75. The first thermal insulation member 74 has a common structure with the thermal insulation member 71 described in Example 1 and is disposed on the first side face 601 of the lower plate 62. The second thermal insulation member 75 is disposed on the first side face 601 of the upper plate 61 of the partition member 60.

The first and second thermal insulation members 74 and 75 may be made of either a common material or different materials. In the example shown in FIG. 7, the first and second thermal insulation members 74 and 75 are made of a common thermally resistant felt and have an equal thickness.

The second thermal insulation member 75 is hence located obliquely upward from the pressure roller 44, thereby more efficiently restraining upward heat transfer from the pressure roller 44.

Example 4

Figure 8:
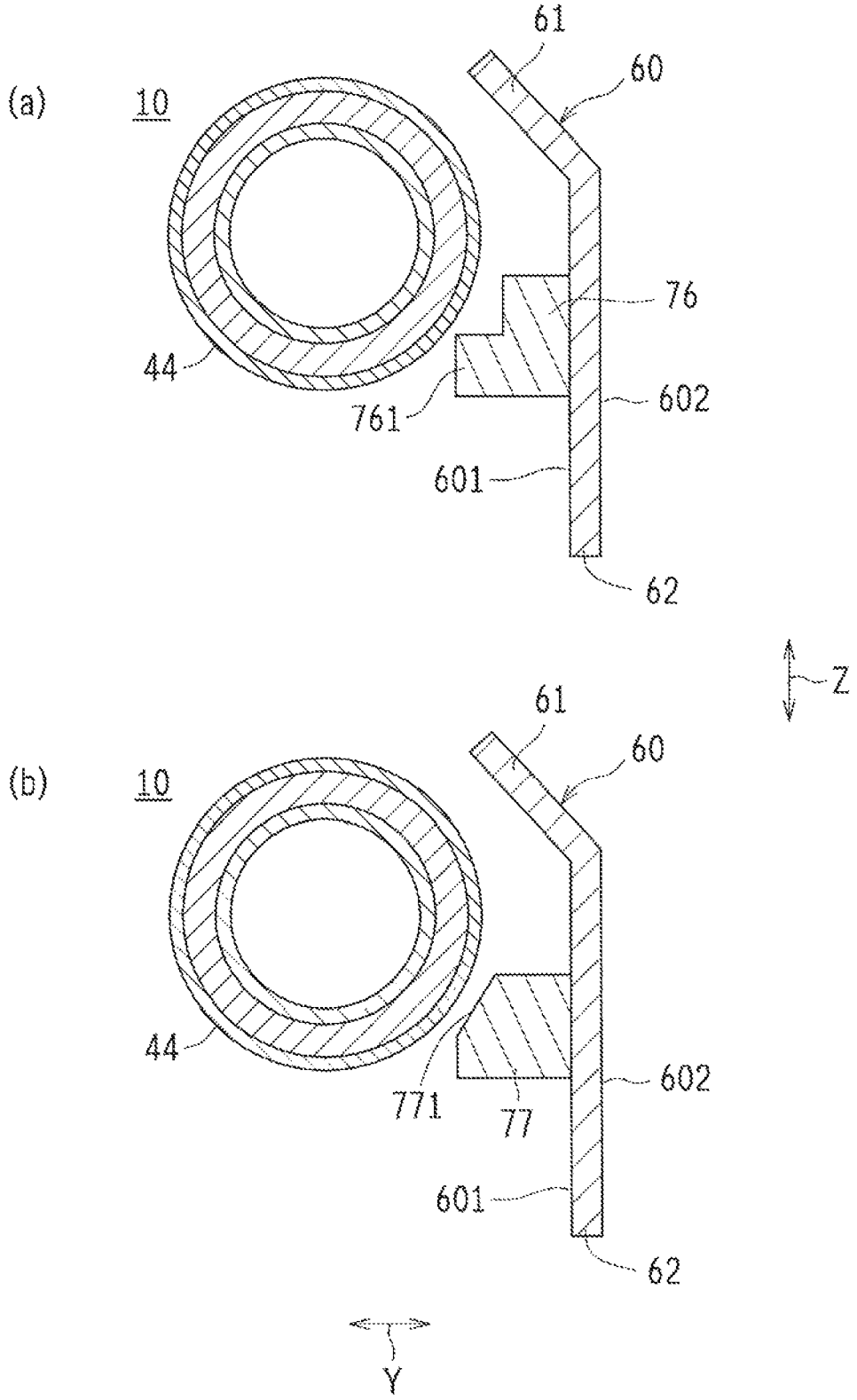
FIG. 8 is a schematic cross-sectional view of a partition member and a thermal insulation member of Example 4 in the fixing device.

FIGS. 8(*a*) and 8(*b*) are schematic cross-sectional views of the partition member 60 and a thermal insulation member 76 or 77 in the fixing device 10 in accordance with Example 4.

The fixing device 10 of Example 4, in comparison with the thermal insulation member 71 in the fixing device 10 in accordance with Example 1 shown in FIG. 3, includes the thermal insulation member 76 or 77 on a lower portion of the first side face 601 of the partition member 60.

In the example shown in FIG. 8(*a*), the thermal insulation member 76 of the lower plate 62 includes a convex section 761 projecting in the thickness direction (left and right direction Y) and is disposed in such a manner as to narrow down the gap between the thermal insulation member 76 and the pressure roller 44. The convex section 761 is disposed on a lower portion of the thermal insulation member 76 with respect to the up and down direction Z. The thermal insulation member 76 is preferably made of thermally resistant felt.

In the example shown in FIG. 8(*b*), the thermal insulation member 77 of the lower plate 62 has an increased thickness in the left and right direction Y and includes an inclined plane 771 facing the exterior of the pressure roller 44. The thermal insulation member 77 is preferably made of thermally resistant foam sponge.

These structures narrow down the gap between the pressure roller 44 and the thermal insulation members 76 and 77, thereby retaining heat inside the housing 50 and maintaining the temperature of the pressure roller 44.

Example 5

Figure 9:
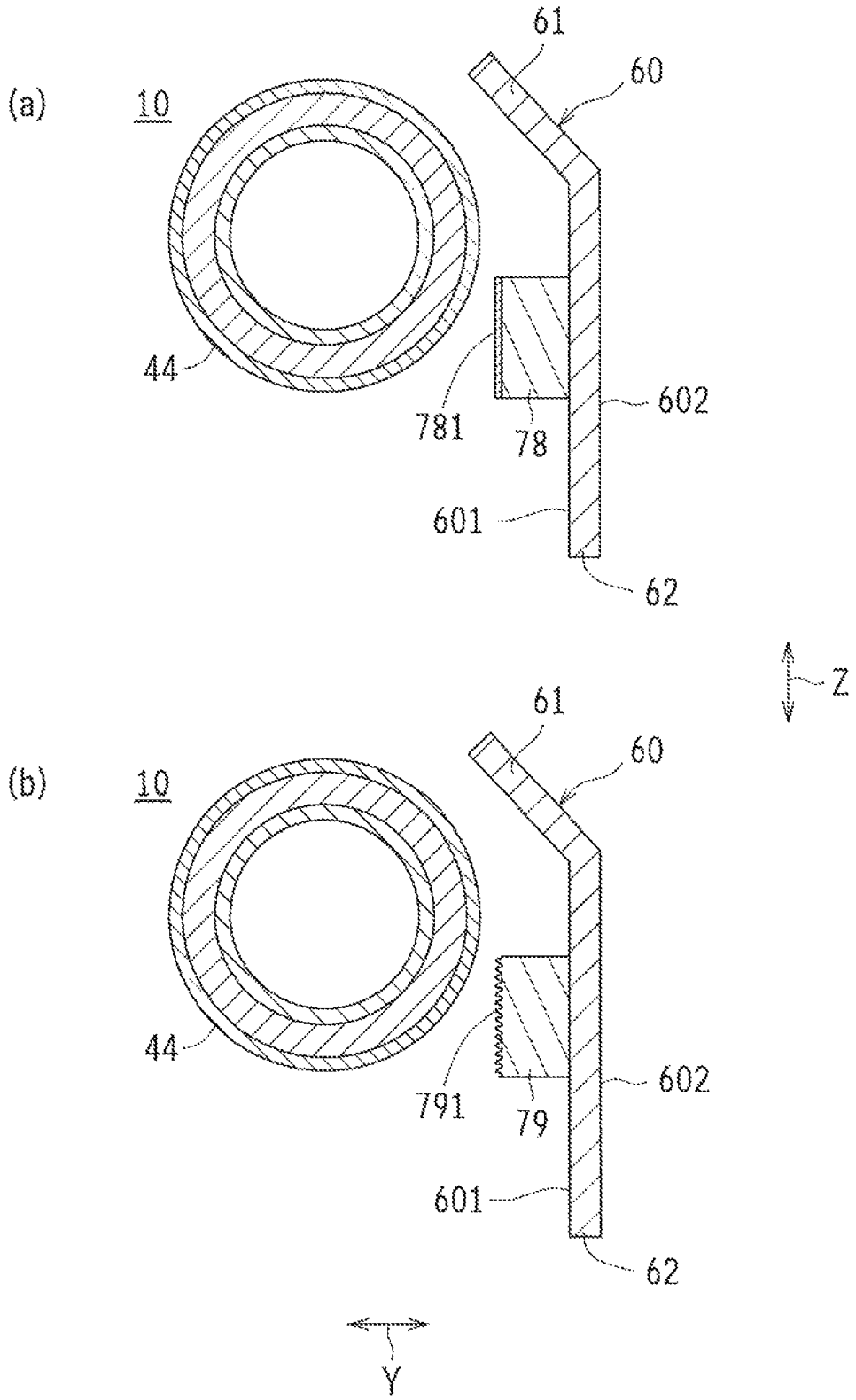
FIG. 9 is a schematic cross-sectional view of a partition member and a thermal insulation member of Example 5 in the fixing device.

FIGS. 9(*a*) and 9(*b*) are schematic cross-sectional views of the partition member 60 and a thermal insulation member 78 or 79 in the fixing device 10 in accordance with Example 5. The fixing device 10 of Example 5 includes the thermal insulation member 78 or 79 which has a characteristic surface shape.

In the example shown in FIG. 9(*a*), the thermal insulation member 78, made of thermally resistant felt or thermally resistant foam sponge, includes a high-reflection sheet 781 on the surface thereof facing the pressure roller 44. The high-reflection sheet 781 may be made of, for example, a thermal shield sheet material prepared by attaching aluminum foil to glass cloth. The provision of the high-reflection sheet 781 can impart excellent thermal resistance and provide a superb thermal shield to the thermal insulation member 78, thereby restraining heat transfer to the partition member 60 and efficiently maintaining the temperature of the pressure roller 44.

As an alternative, the thermal insulation member 79 may include a rough face 791 on the surface thereof facing the pressure roller 44 as shown in FIG. 9(*b*). The provision of the rough face 791 on the thermal insulation member 79 disrupts the air current above the surface the thermal insulation member 79, thereby restraining the convection current of air around the pressure roller 44 and maintaining the temperature of the pressure roller 44.

Embodiment 2

Figure 10:
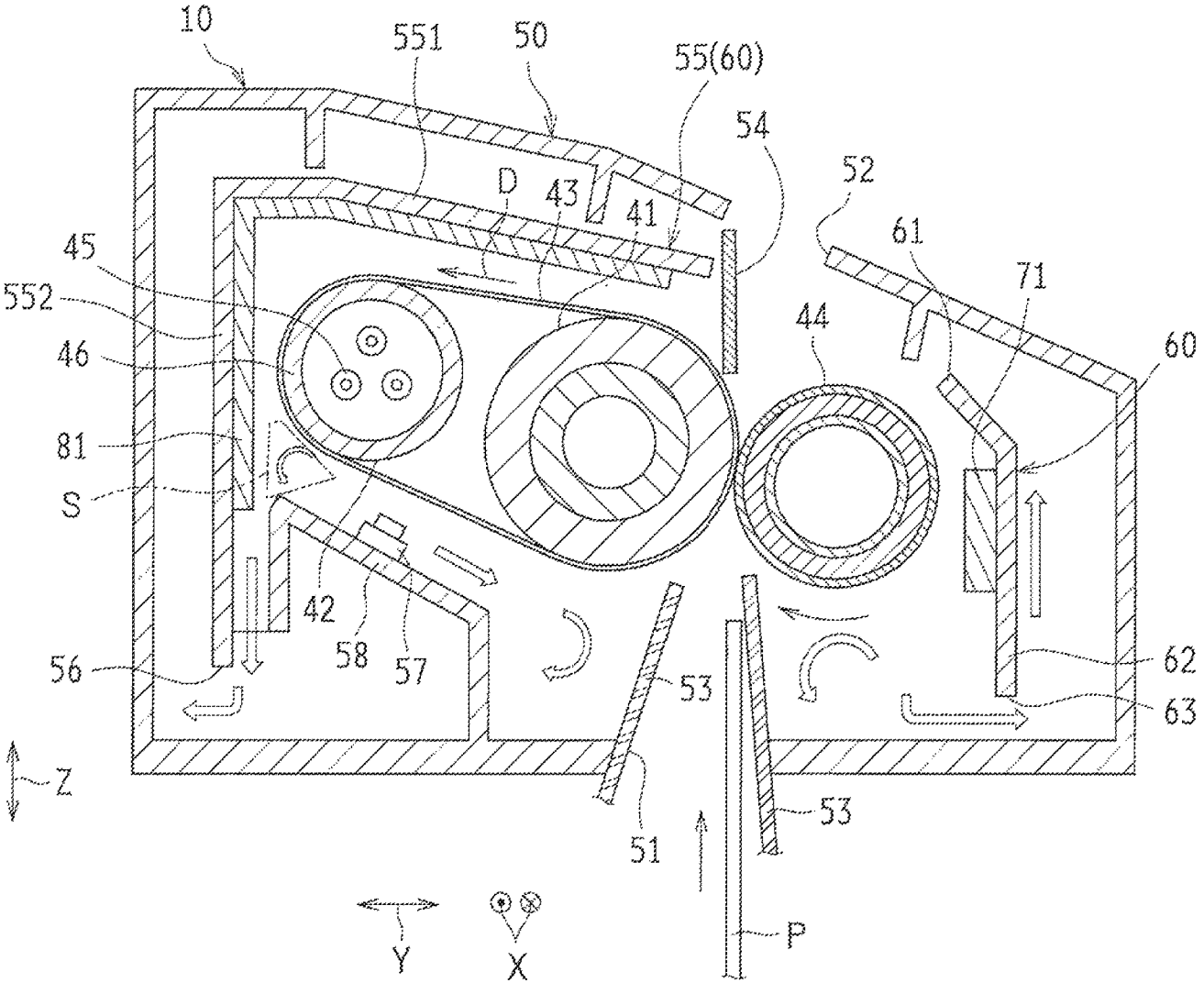
FIG. 10 is a schematic cross-sectional view of a fixing device in accordance with Embodiment 2 of the present invention.

FIG. 10 is a schematic cross-sectional view of a fixing device 10 in accordance with Embodiment 2 of the present invention. The fixing device 10 in accordance with Embodiment 1 includes the partition member 60 between the pressure roller 44 (rotation member) and the inner faces of the housing 50. The fixing device 10 in accordance with Embodiment 2 further includes an additional partition member between the fixing belt 43 (rotation member) and the inner faces of the housing 50.

Referring to FIG. 10, the endless fixing belt 43 (rotation member) is suspended by the fixing roller 41 and the heating roller 42 in the housing 50. The fixing roller 41 is pressed against the pressure roller 44 via the fixing belt 43. The fixing belt 43 is heated by the heating members 45 inside the heating roller 42.

The fixing belt 43 is supported by the belt support member 55 in the housing 50. The belt support member 55 is disposed between the inner faces of the housing 50 and the fixing belt 43 so as to surround the exterior of the fixing belt 43. In the fixing device 10 in accordance with Embodiment 2, the belt support member 55 doubles as a partition member of the present invention to restrain temperature drops in the air around the fixing belt 43.

The belt support member 55, serving as another partition member in the housing 50, includes a thermal insulation member 81 facing the fixing belt 43. In the example shown in FIG. 10, the belt support member 55 includes an upper plate portion 551 extending along and above the fixing belt 43 approximately in the left and right direction Y and a side plate portion 552 extending in the up and down direction from an end of the upper plate portion 551.

The belt support member 55 has a length in the rotation-axis direction X that is greater than or equal to the width of the fixing belt 43 (length of the member in the rotation-axis direction X). With this specification, the belt support member 55 can be disposed in the housing 50 in such a manner as to have a cross-sectional shape that bends so as to enclose the side faces of the fixing belt 43 and the heating roller 42.

There is provided an opening 56 below the side plate portion 552 of the belt support member 55. There is also erected a support member 58 below the fixing belt 43 inside the housing 50. The support member 58 is provided with a thermistor 57 as a temperature sensor that detects the temperature of the fixing belt 43.

The thermal insulation member 81 is disposed on a lower surface of the upper plate portion 551 facing the fixing belt 43 and on an inner surface of the side plate portion 552 facing the fixing belt 43. The thermal insulation member 81, similarly to the belt support member 55, has a length in the rotation-axis direction X that is greater than or equal to the width of the fixing belt 43.

The thermal insulation member 81 may have the same structure as the one described in Embodiment 1 and is preferably made of thermally resistant felt or thermally resistant foam sponge. For instance, the thermal insulation member 81 is made of thermally resistant felt with a thermal conductivity of from 0.04 to 0.15 W/mK and a thickness of 2 mm and is disposed so as to have a gap of 1 to 2 mm between the thermal insulation member 81 and the fixing belt 43.

As the fixing belt 43 rotates in the direction indicated by arrow D, the gap between the fixing belt 43 and the belt support member 55, although providing a passage for a heat convection current of air, restricts heat transfer to the belt support member 55 because the gap is narrowed down by the thermal insulation member 81. The structure thus generates heat convection around the fixing belt 43, thereby mitigating diffusion of heat.

The space between the thermal insulation member 81 and the fixing belt 43 on the heating roller 42 is narrowed down beside the heating roller 42. In particular, there is provided a heat retention region S below the heating roller 42 between the thermal insulation member 81 and the fixing belt 43. The retention region S can mitigate temperature drops in the air around the fixing belt 43, thereby reducing heat loss.

Some of the convection current of air around the fixing belt 43 moves through the opening 56 below the belt support member 55 and then moves upward through the space between the housing 50 and the belt support member 55. The opening 56 is located on the bottom at a distance from the fixing belt 43. The opening 56 therefore does not affect heat loss by the fixing belt 43.

The fixing device 10 and the image forming apparatus 1 structured in accordance with the present invention as described in the foregoing can reduce heat radiation from the rotation members including the pressure roller 44 and the fixing belt 43 to the housing 50, thereby retaining heat around the rotation members. This arrangement can reduce the heat lost through the surfaces of the rotation members including the pressure roller 44 and the fixing belt 43, thereby preventing temperature drops during the standby time. That can in turn shorten the heat-up time and thus reduce the power consumption of the image forming apparatus 1.

In the present invention, the partition member on which there is provided a thermal insulation member may be located between the housing and any rotation member in the housing. The partition member is not necessarily limited to the embodiments and may take any shape, location, and other properties and specifications. The embodiments disclosed above are for illustrative purposes only and provide no basis for restrictive interpretations of the present invention. The present invention may be altered within the scope of the claims. Embodiments based on a proper combination of technical means disclosed in different embodiments are encompassed in the technical scope of the present invention.

What is claimed is:

1. A fixing device comprising:

a rotation member;

a housing enclosing the rotation member; and a partition member providing a partition between the rotation member and an inner face of the housing, wherein the partition member is disposed against the rotation member along a rotation-axis direction of the rotation member, the partition member has a first side face against the rotation member, the first side face being provided with a thermal insulation member thereon, the thermal insulation member is separated from the rotation member by a prescribed distance, and the distance separating the thermal insulation member from the rotation member is smaller than a thickness of the thermal insulation member in a direction perpendicular to the rotation-axis direction of the rotation member.

2. The fixing device according to claim 1, wherein the partition member has a second side face opposite the first side face, the second side face being separated from the inner face of the housing by a space.

3. The fixing device according to claim 1, wherein the thermal insulation member includes thermal insulation material layers of different thermal conductivities stacked in a thickness direction.

4. The fixing device according to claim 3, wherein the thermal conductivity of one of the thermal insulation material layers that is stacked on a partition member side is smaller than the thermal conductivity of one of the thermal insulation material layers that is stacked on a rotation member side.

5. The fixing device according to claim 1, wherein the partition member is bent along an exterior of the rotation member.

6. The fixing device according to claim 1, wherein the rotation member comprises a fixing roller, a fixing belt suspended by the fixing roller, or a pressure roller to be pressed against the fixing roller.

7. An image forming apparatus comprising the fixing device according to claim 1.

* * * * *